United States Patent [19]

Taylor et al.

[11] Patent Number: 4,569,272

[45] Date of Patent: Feb. 11, 1986

[54] POWER TRANSMISSION

[75] Inventors: Henry D. Taylor, Pontiac; Vinod K. Nanda, Rochester, both of Mich.

[73] Assignee: Vickers, Incorporated, Troy, Mich.

[21] Appl. No.: 606,985

[22] Filed: May 4, 1984

Related U.S. Application Data

[63] Continuation-in-part of Ser. No. 360,604, Mar. 22, 1982, abandoned.

[51] Int. Cl.[4] ..... F15B 13/042

[52] U.S. Cl. ..... 91/420; 91/433; 91/441; 91/445; 137/625.62

[58] Field of Search ..... 91/420, 441, 433, 445, 91/447, 450, 451; 137/625.62

[56] References Cited

U.S. PATENT DOCUMENTS

| | | | |
|---|---|---|---|
| 4,065,010 | 12/1977 | Worback | 91/420 |
| 4,278,010 | 7/1981 | Wallischeck et al. | 91/420 |
| 4,342,256 | 8/1982 | Andersen et al. | 91/420 |
| 4,407,122 | 10/1983 | Nanda | 91/433 |

*Primary Examiner*—Robert E. Garrett
*Assistant Examiner*—Richard S. Meyer
*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions, a pump for supplying fluid to said actuator, pilot operated meter-in valve to which the fluid from the pump is supplied for controlling the direction of movement of the actuator, and pilot operated meter-out valve associated with at least one opening of the actuator for controlling the flow out of said actuator. The pressure of fluid being supplied to the actuator by the meter-in valve means is sensed and caused to produce a force opposing the movement of the meter-in valve means by the pilot pressure and also applied to a device for controlling an overhauling load resulting in a smooth and accurate control of the movement of the actuator.

2 Claims, 10 Drawing Figures

POWER TRANSMISSION

This application is a continuation-in-part of application Ser. No. 360,604 filed Mar. 22, 1982, now abandoned.

This invention relates to power transmission in hydraulic systems that are found, for example, on mobile equipment such as excavators and cranes.

BACKGROUND AND SUMMARY OF THE INVENTION

In U.S. Pat. No. 4,201,052, incorporated herein by reference, there is disclosed a pilot pressure operated high pressure load sensing valve system incorporated in a valve body designed to be mounted directly on an actuator to be controlled such as a hydraulic cylinder or hydraulic motor. The valve system accurately controls the position and speed of operation of the actuator.

In brief, the valve system disclosed in the aforementioned patent comprises an independent pilot operated meter-in element; a pair of load drop check valves; a pair of independently operated normally closed meter-out elements; a pair of load pressure responsive valves; and a pair of anti-cavitation valves. The meter-in element functions to direct fluid flow to one or the other of the actuator ports. The normally closed meter-out elements are associated with each of the actuator ports for controlling fluid flow from the port opposite to the actuator port to which the meter-in element is directing fluid. The meter-out elements function as variable orifices metering fluid between the appropriate actuator port and a low pressure zone such as a reservoir tank. Each of the meter-out elements has associated therewith the load pressure responsive valves which act on the meter-out elements in response to load pressure to enable the meter-out elements to also provide pressure relief protection. The anti-cavitation valves are associated with each of the actuator ports and are adapted to open the appropriate port to tank.

The valve system is directly mounted on the actuator port manifold and is supplied by one full flow high pressure line, a pair of pilot pressure lines, and a load sensing line. The operation of the valve system is controlled through the pilot lines from a manually operated hydraulic remote control valve. In the absence of a command signal from the hydraulic remote control, the meter-in element assumes a centered or neutral position with the check valves, the meter-out elements, the pressure responsive valves, and the anti-cavitation valves, all in closed position. In the neutral position, the valve system hydraulically locks the load in position. Fluid flow from the actuator is blocked thereby preventing uncontrolled lowering of an overhauling load in the event of a rupture of any of the connecting hydraulic lines. Since the valve system is a load sensing system, the pump output is made to match that which is required by the load. In contrast, in a non-load sensing system, the pump output may exceed that required by the load with the excess power being dissipated as heat.

In certain high inertial loads such as swing drives on an excavator which utilize rotary actuators, smooth stopping and starting of the load and accurate positioning of the load are very essential.

A hydraulic system providing for smooth stopping and starting and accurate positioning of the load under high inertial loads is disclosed in our copending U.S. application Ser. No. 264,342 filed May 18, 1981, now U.S. Pat. No. 4,407,122, wherein means are provided for sensing the pressure being directed to the actuator by the meter-in element and providing a feedback pressure using a small piston on the meter-in element opposing the pilot pressure tending to open the meter-in valve element.

Under certain conditions, it may not be possible or desirable to mount the valve system directly on the actuator. Such conditions may exist due to space limitations on the actuator or wherein it is desirable to limit the number of supply and pilot lines, such as to the topmost section of a telescoping boom or when a brake, such as in a winch-type application, is used for counterbalancing the load. Under these conditions, the valve system is mounted on the equipment remote from the actuator with a pair of lines running to the actuator port manifold.

In the latter situation it may be desirable to provide for controlled lowering or holding of the load at the actuator port manifold. In that case a conventional counterbalance valve is interposed between one of the actuator ports and the line leading from the valve system to the actuator port. In such an arrangement as disclosed our copending U.S. application Ser. No. 320,448 filed Nov. 12, 1981, now abandoned and refiled as pending U.S. application Ser. No. 605,607, filed Apr. 30, 1984, having a common assignee with the present application, the return flow from the actuator must pass through a normally open meter-out or exhaust element so as not to interfere with the desired control of the load through the counterbalance valve or brake. The normally open element is closed only when flow is delivered to the actuator in the opposite direction.

However, in the above described situation, when the meter-in valve is used as a flow control unit, it is usually difficult to obtain optimum stability of the load due to the high pressure gain in the outlet line of the meter-in valve.

Accordingly, it is an object of the present invention to provide a valve system of the aforementioned type which is operable in a counterbalance mode or with the use of external counterbalance valves or brakes with improved stability.

It is further an object of the invention to provide a hydraulic system having a proportional relationship between metered fluid flow and pressure in the output line of a flow control valve to maintain stability in the controlled lowering of an overhauling load.

It is another object of this invention to provide a hydraulic system which incorporates means for controlling an overhauling load and which hydraulic system has greater stability than prior hydraulic systems.

It is still another object of this invention to provide a hydraulic system incorporating a metering valve using pressure feedback to achieve system stability in the controlled lowering of an overhauling load.

In accordance with the invention, the meter-in element of the above described valve system is provided with a small feedback or load piston to establish a steady-state relationship between the metered flow and the outlet pressure of the valve system. The controlled pressure established by this steady-state relationship is used to control external counterbalance valves or to provide for the controlled release of a brake if it is desired to control an overhauling load by braking rather than hydraulic metering. The present invention also provides for operating one of the meter-out elements of the valve system as a counterbalance valve when it is desirable to mount the valve system directly to the actuator port manifold.

In accordance with another aspect of the invention, the load piston is not utilized but the circuit provides for counterbalance valves or brakes to control an overhauling load.

DESCRIPTION

Figure 1:
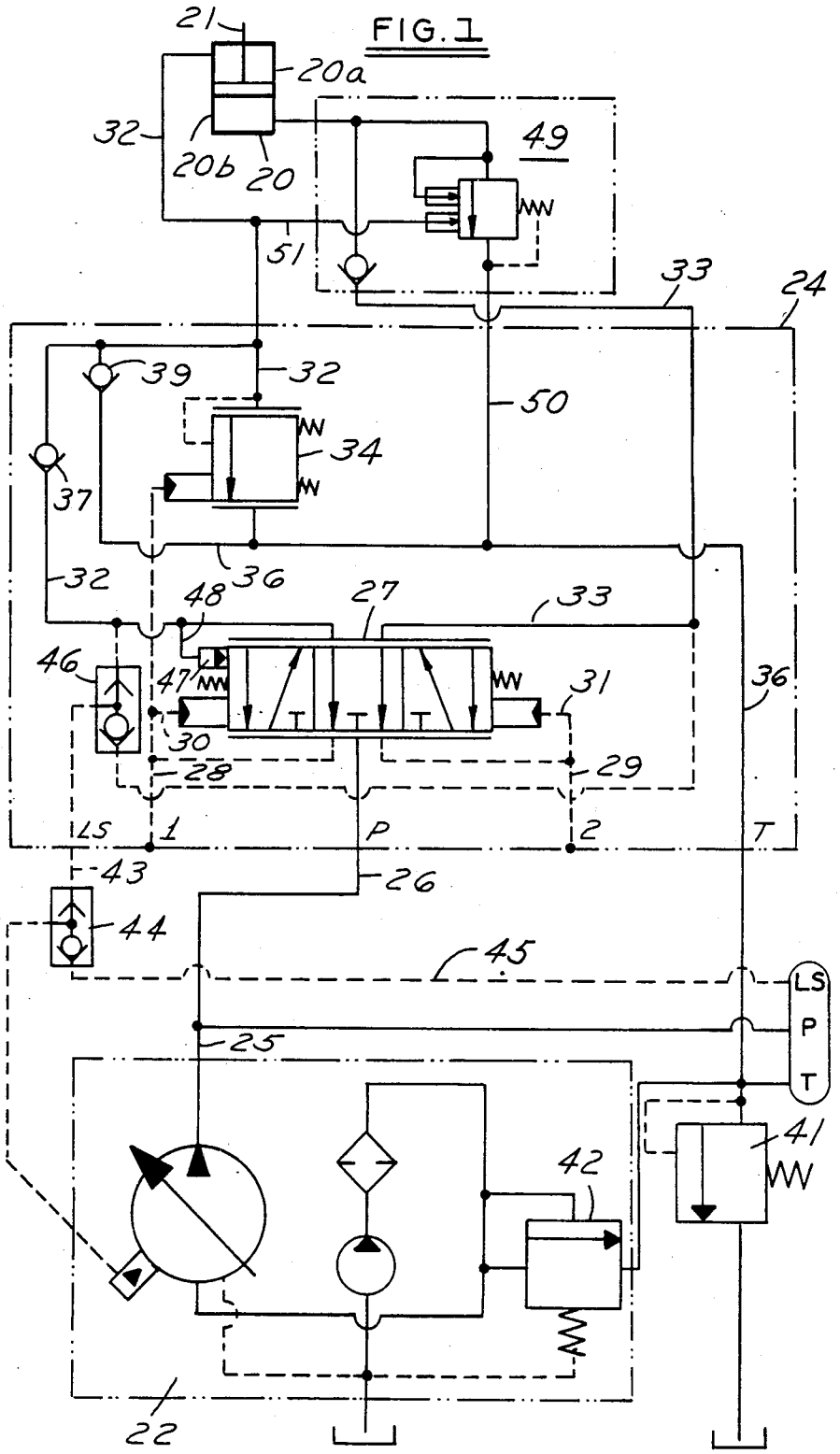
FIG. 1 is a schematic drawing of the hydraulic circuit embodying the invention.

Referring to FIG. 1, the hydraulic system embodying the invention comprises an actuator 20, herein shown as a linear hydraulic cylinder, a rod end 20*a*, a piston end 20*b* and output shaft 21 extending from the rod end that is moved in opposite directions by hydraulic fluid supplied from a variable displacement pump system 22 which has load sensing control in accordance with conventional construction. The hydraulic system further includes a manually operated controller, not shown, that directs a pilot pressure to a valve system 24 for controlling the direction of movement of the actuator, as presently described. Fluid from the pump 22 is directed to the line 25 and line 26 to a meter-in valve 27 that functions to direct and control the flow of hydraulic fluid to one or the other end of the actuator 20. The meter-in valve 27 is pilot pressure controlled by controller, not shown, through lines 28, 29 and lines 30, 31 to the opposed end thereof, as presently described. Depending upon the direction of movement of the valve, hydraulic fluid passes through a line 32, connected with the rod end 20*a* and a line 33 connected with the piston end 20*b* of the actuator 20.

The hydraulic system further includes a meter-out valve 34 associated with the rod end 20*a* of the actuator in line 32 for controlling the flow of fluid from the rod end 20*a* of the actuator.

The hydraulic system further includes spring-loaded poppet valves 37, 38 in the lines 32, 33 and spring-loaded anti-cavitation valves 39, 40, shown in FIGS. 2–5, which are adapted to open the lines 32, 33 to the tank passage 36.

The system also includes a back pressure valve 41 associated with the return or tank line. Back pressure valve 41 functions to minimize cavitation when an overrunning or a lowering load tends to drive the actuator down. A charge pump relief valve 42 is provided to take excess flow above the inlet requirements of the pump 22 and apply it to the back pressure valve 41 to augment the fluid available to the actuator.

Meter-in valve 27 comprises a bore in which a spool is positioned and in the absence of pilot pressure maintained in a neutral position by springs. The spool normally blocks the flow from the pressure passage 26 to the passages 32, 33. When pilot pressure is applied to either passage 30 or 31, the meter-in spool is moved in the direction of the pressure until a force balance exists among the pilot pressure, the spring load and the flow forces. The direction of movement determines which of the passages 32, 33 is provided with fluid under pressure from passage 26.

When pilot pressure is applied to line 28, leading to meter-out valve 34, the valve is actuated to allow flow from the rod end 20*a* of actuator 20 to tank passage 36.

It can thus be seen that the same pilot pressure which functions to open the meter-in valve to meter fluid to piston end 20*b* also functions to determine and control the opening of the meter-out valve so that the fluid in the rod end 20*a* of the actuator can return to the tank line 36.

Provision is made for sensing the maximum load pressure in one of a multiple of valve systems 24 controlling a plurality of actuators and applying that higher pressure to the load sensitive variable displacement pump 22. Each valve system 24 includes a line 43 extending to a shuttle valve 44 that receives load pressure from an adjacent actuator through line 45. Shuttle valve 44 senses which of the pressures is greater and shifts to apply the higher pressure to pump 22. Thus, each valve system in succession incorporates a shuttle valve 46 which compares the load pressure in lines 32 and 33 and signals the higher of the two pressures to shuttle valve 46 which is then compared with the load pressure of an adjacent valve system. The higher pressure is transmitted to the adjacent valve system in succession and finally the highest load pressure is applied to pump 22.

The above described circuit is similar to that shown and described in the aforementioned U.S. Pat. No. 4,201,052 which is incorporated herein by reference. The single meter-in valve 27 may be replaced by two meter-in valves.

The details of the preferred construction of the elements of the hydraulic circuit are more specifically described in the aforementioned U.S. Pat. No. 4,201,052 which is incorporated herein by reference.

In accordance with the invention, the left side of meter-in valve 27 is provided with a load piston 47 which is connected by line 48 so that it senses outlet pressure being directed to the rod end 20*a* of the actuator and provides a pressure on the meter-in valve 27 opposing the pilot pressure which is tending to open the meter-in valve 27 in a direction to supply fluid to the rod end 20*a* of the actuator. In addition, a conventional counterbalance valve 49 is connected between tank line 36 and line 33. Pressure from line 32 is applied to the counterbalance valve 49 through line 51 to tend to open the counterbalance valve.

When the meter-in valve 27 is operated to shift its spool to the left and supply fluid to the rod end 20*a* of the actuator 21, the pressure of the fluid will open the counterbalance valve 49 and permit fluid to be exhausted from the piston end 20*b* of the actuator to tank line 36. When the load tends to overrun, the pressure in lines 32 and 51 will be reduced and the counterbalance valve 49 will tend to close. However, the lessening in the pressure will be sensed in line 48 lessening the pressure on the load piston 47 so that the meter-in valve 27 can open to a greater degree under the control of the pilot pressure. As a result, there is established a more stable system under overhauling loads.

The load piston 47 and its interrelationship are described in the aforementioned U.S. Pat. No. 4,407,122 which is incorporated herein by reference.

As shown in U.S. Pat. No. 4,407,122 the meter-in valve 27 includes a load sensing bleed orifice. The load or outlet pressure is also applied to the end of the load piston through a passage so that load pressure acts on an area equivalent to the area of the piston opposing the force tending to open the spool of the meter-in valve 27. In the application, a load piston is provided at both ends of the meter-in valve, as contrasted to the present invention wherein the load piston is applied to the end of the meter-in valve 27 which controls flow to the actuator in a situation where an overhauling load may occur.

Figure 2:
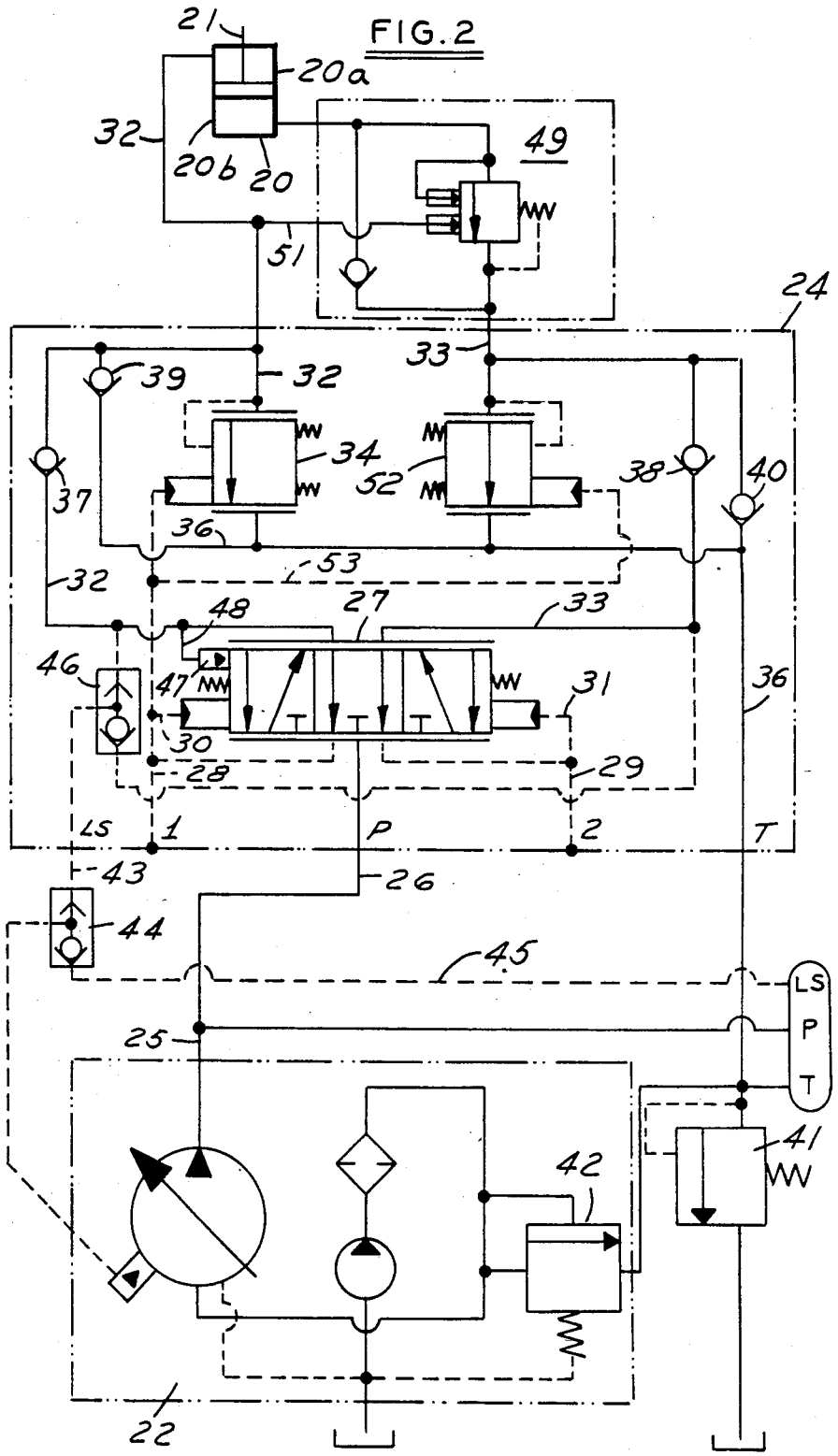
FIG. 2 is a schematic drawing of another hydraulic circuit embodying the invention.

In the hydraulic system shown in FIG. 2, the counterbalance valve 49 is interposed between line 33 and piston end **20*b* and a second meter-out valve 52 is provided between line 33 and tank line 36 in series with the counterbalance valve 49. Meter-out valve 52 is normally open. When pilot pressure is provided to open the meter-in valve 27 to direct fluid to the piston end 20*b* of actuator through line 33, the same pilot pressure closes meter-out valve 52 through a line 53 and opens meter-out valve 34 as in the circuit of FIG. 1. When fluid is applied to the rod end 20*a* of the actuator the system functions to stabilize an overhauling load condition in the same manner as the circuit in FIG. 1**.

Figure 3:
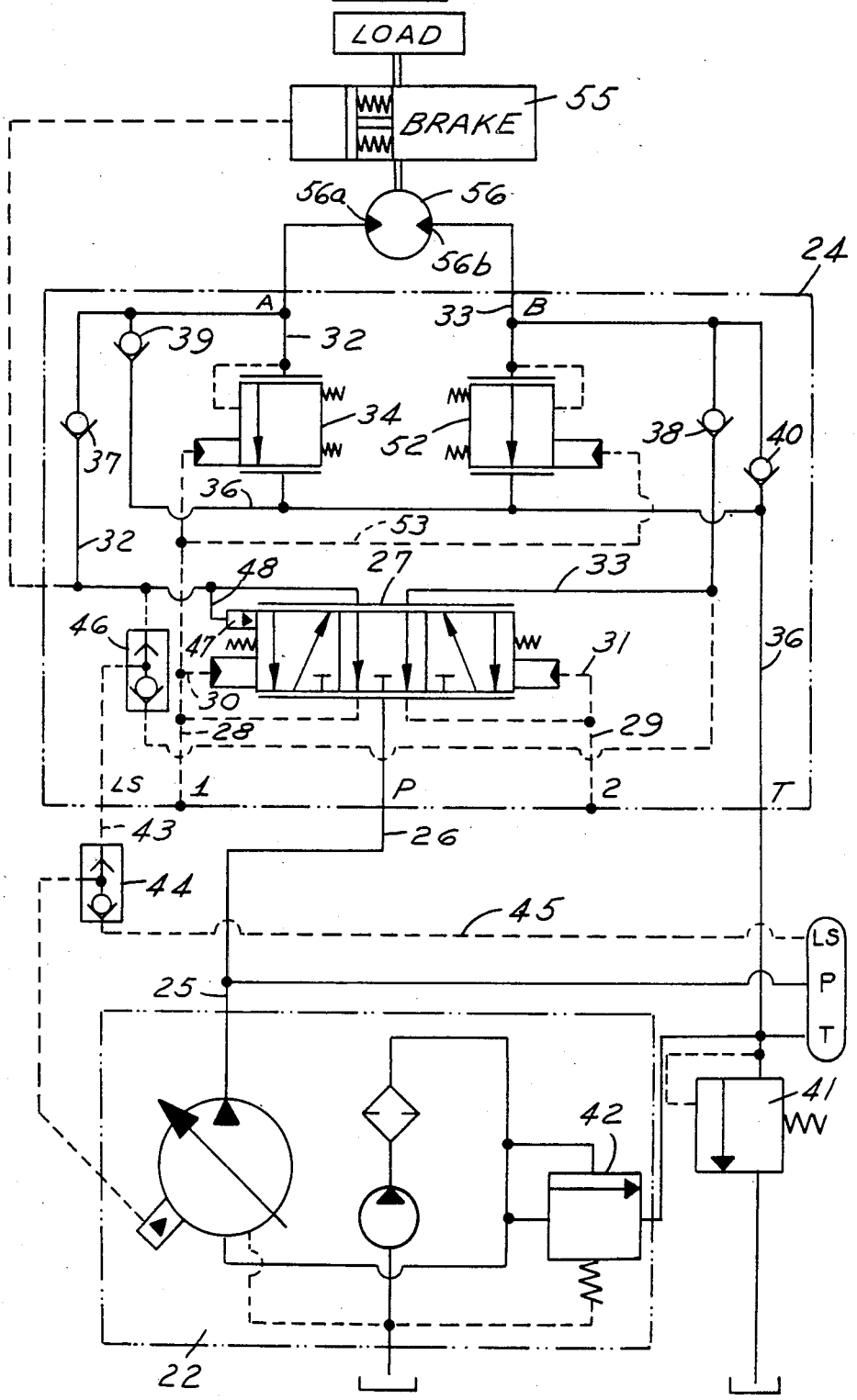
FIG. 3 is a schematic drawing of another hydraulic circuit embodying the invention.

Referring to FIG. 3, a circuit is shown wherein a hydraulic brake 55 is utilized to control a lowering or possible overhauling load and the actuator comprises a rotary hydraulic motor 56 having ports **56*a* and 56*b*. Otherwise the circuit is the same as shown in FIG. 2**.

Figure 4:
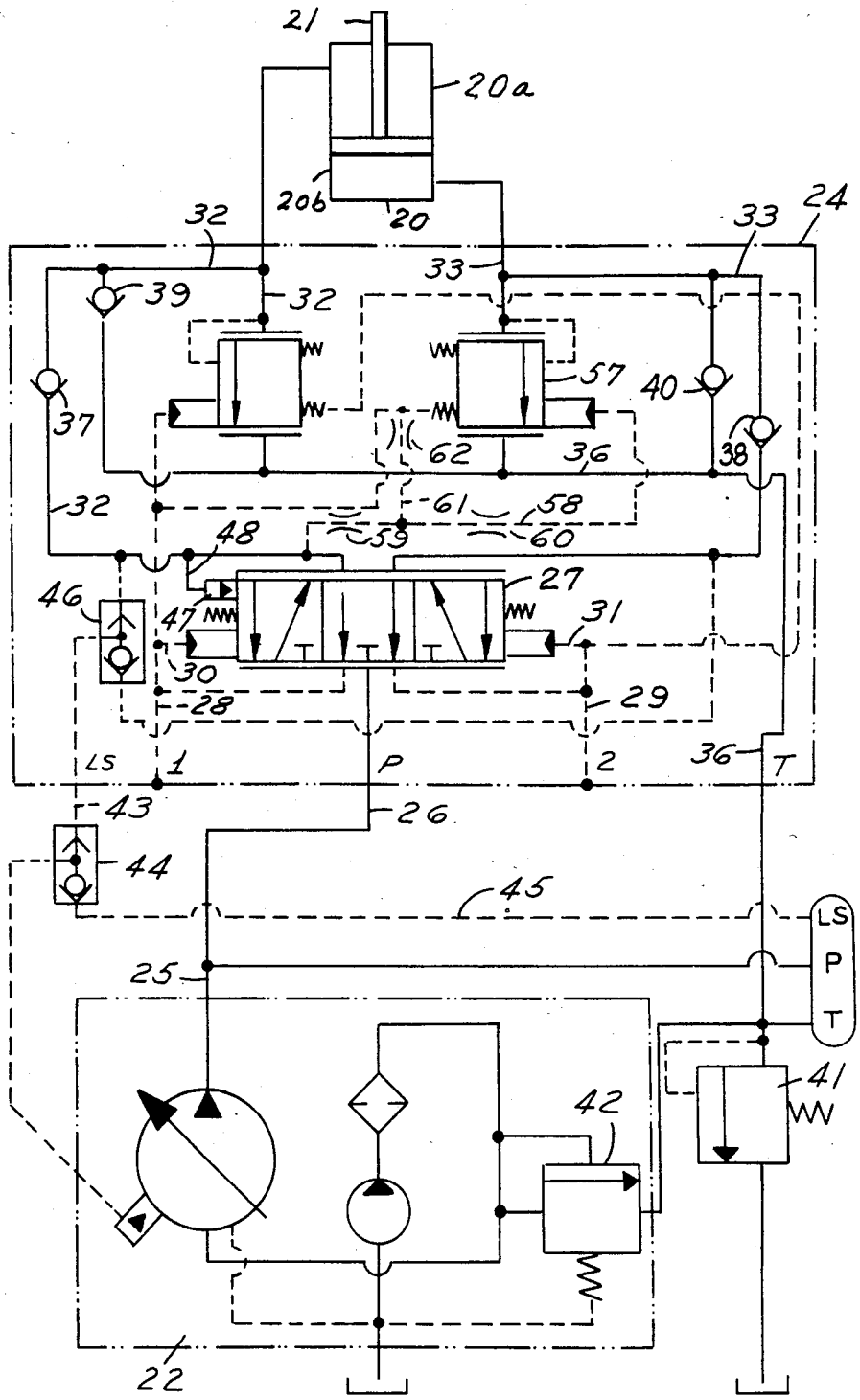
FIG. 4 is a schematic drawing of another hydraulic circuit embodying the invention.

When the meter-in valve 27 is operated to direct fluid to lower a load, the pressure of the fluid in line 32 is applied to disengage the brake 55. If the load tends to overrun, the pressure in line 32 is reduced tending to re-engage the brake. However, the line 48 senses the reduced pressure and applies a lesser pressure to piston 47 so that the meter-in valve 27 will open to a greater degree causing increased pressure in line 32 and again disengaging the brake, thereby providing greater stability.

Where the meter-in and meter-out valves can be located at the actuator, the hydraulic system shown in FIG. 4 can be used. This is similar to that of FIG. 1 except that the counterbalance valve is omitted. Instead, the system comprises a meter-in valve 27 and normally closed pilot operated meter-out valves 34 and 57, in the manner of the aforementioned U.S. Pat. No. 4,201,052. In addition, the left hand end of meter-in valve 27 includes the piston 47 and line 48.

The second meter-out valve 57 is not opened by pilot pressure but by pressure of the fluid to the rod end **20*a* of the actuator applied through line 58**.

When meter-in valve 27 is operated to direct fluid to the rod end **20*a* of the actuator for lowering a load, the second meter-out valve 57 functions as a counterbalance valve. Initially it is opened, but if the load tends to overrun, the reduction in pressure in line 32 and line 58 tends to close meter-out valve 57**.

However, this pressure reduction is sensed through line 48 and reduces the force on piston 47 thereby permitting the meter-in valve to open further increasing the pressure in lines 32, 33 and again opening the meter-out valve 57.

When the meter-in valve 27 is moved to a neutral position from a moved position, anti-cavitation valves 39, 40 serve to supply additional fluid to the inlet of the actuator to prevent cavitation of the actuator. In this situation pressure in line 32 decays through line 28. The decay in pressure is sensed at the second meter-out valve 57 through line 58 causing the second meter-out valve 57 to close. Inertia of the load tends to force fluid out of the exhaust port of the actuator building up pressure in line 33. When the pressure in line 33 exceeds the relief setting of the second meter-out valve 57, the meter-out valve 57 opens again allowing the exhaust fluid to join the fluid being pumped through line 36 to the anti-cavitation valve 39 or 40 by the charge pump.

When meter-in valve 27 is operated to direct fluid to the actuator, restrictors 59 and 62 placed in lines 58 and 61 provide for an approximately four to one (4:1) build-up of pressure between the pressure in lines 32 and 58 i.e. the second meter-out valve 57 will crack open at one-fourth the pressure in line 32. The build-up of the pressure in line 32 will apply back pressure on anti-cavitation valve 39 preventing recirculation of fluid exhausting from the second meter-out valve 57 to the actuator. Such recirculation of fluid would result in undesirable overspeeding when the actuator is driven by an overhauling load. Applying back pressure to the anti-cavitation valve 39 also prevents over-heating of the actuator by allowing fresh fluid to be applied to the actuator by the pump. Restrictors 59 and 62 in combination with restrictor 60 in line 58 also augment the load stability by providing additional damping to the system, i.e. slowing the speed of response of the second meter-out valve 57 when subjected to sudden pressure surges.

Figure 5:
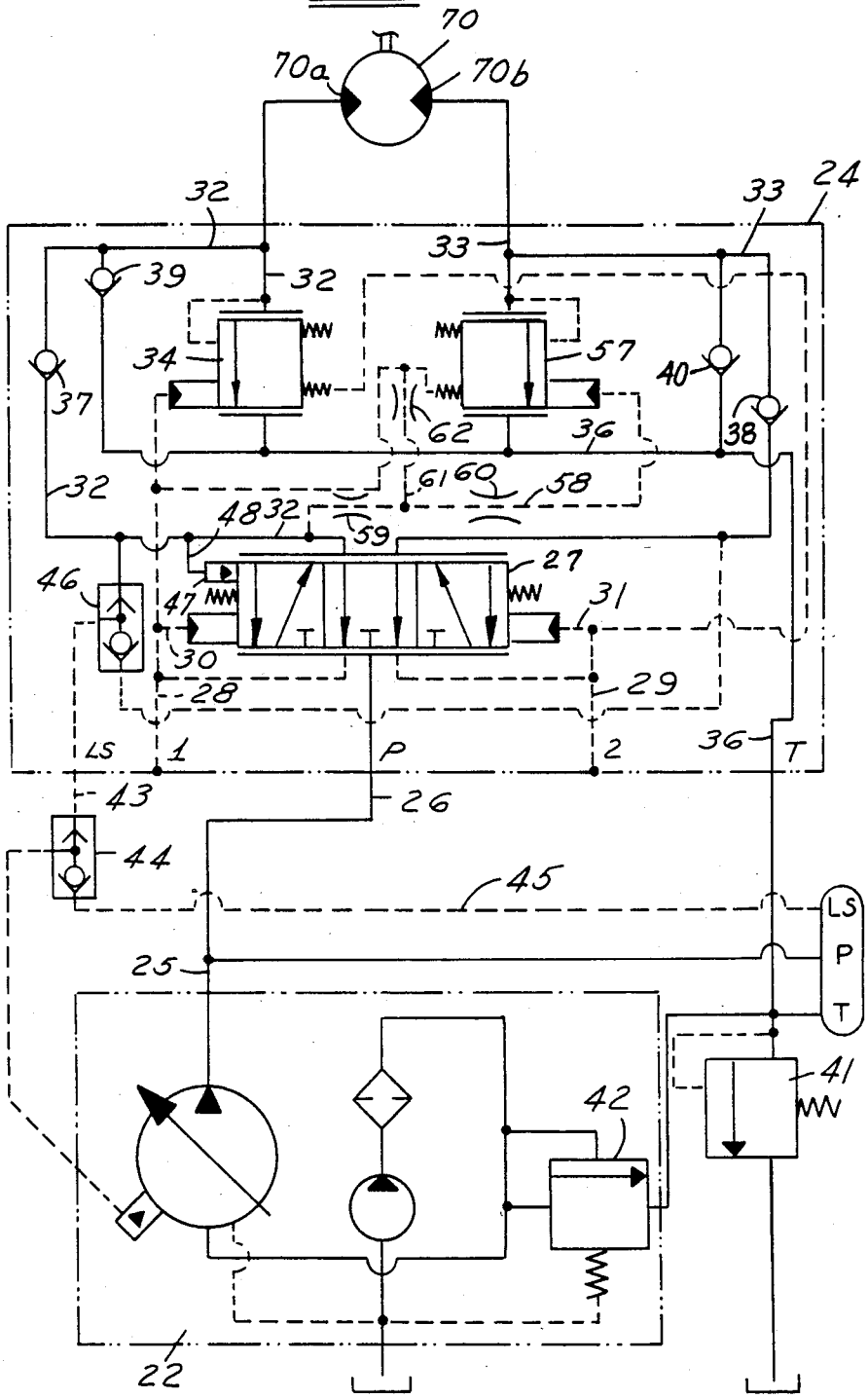
FIG. 5 is a schematic drawing of another hydraulic circuit embodying the invention.

Referring to FIG. 5, the valve system shown is similar to that shown in FIG. 4 wherein the meter-out valve 57 functions in a counterbalance mode as previously described. However, in this case the actuator comprises a rotary hydraulic motor 70 having ports **70*a* and 70*b*. In the case of a rotary motor the second meter-out valve 57 is not opened by pilot pressure but by pressure of fluid applied to port 70*a* through line 32 and applied to the meter-out valve 57 through line 58. As in the case of the actuator of FIG. 4, restrictors 59, 60 placed in line 58 and restrictor 62 in line 61** prevent recirculation of fluid through the rotary motor which would result in an overspeeding condition of the motor or overheating of the motor.

It can thus be seen that the controlled outlet pressure out of the meter-in valve means is utilized to control either a counterbalance valve or a hydraulic brake for controlling the overhauling load. The meter-out valve which normally controls the flow in the direction of the overhauling load can be omitted or operated as a normally open valve when an external counterbalance is used. The meter-out valve must also be normally open when a brake is used and when a meter-out valve is used as a counterbalance valve it must be normally closed.

Figure 6:
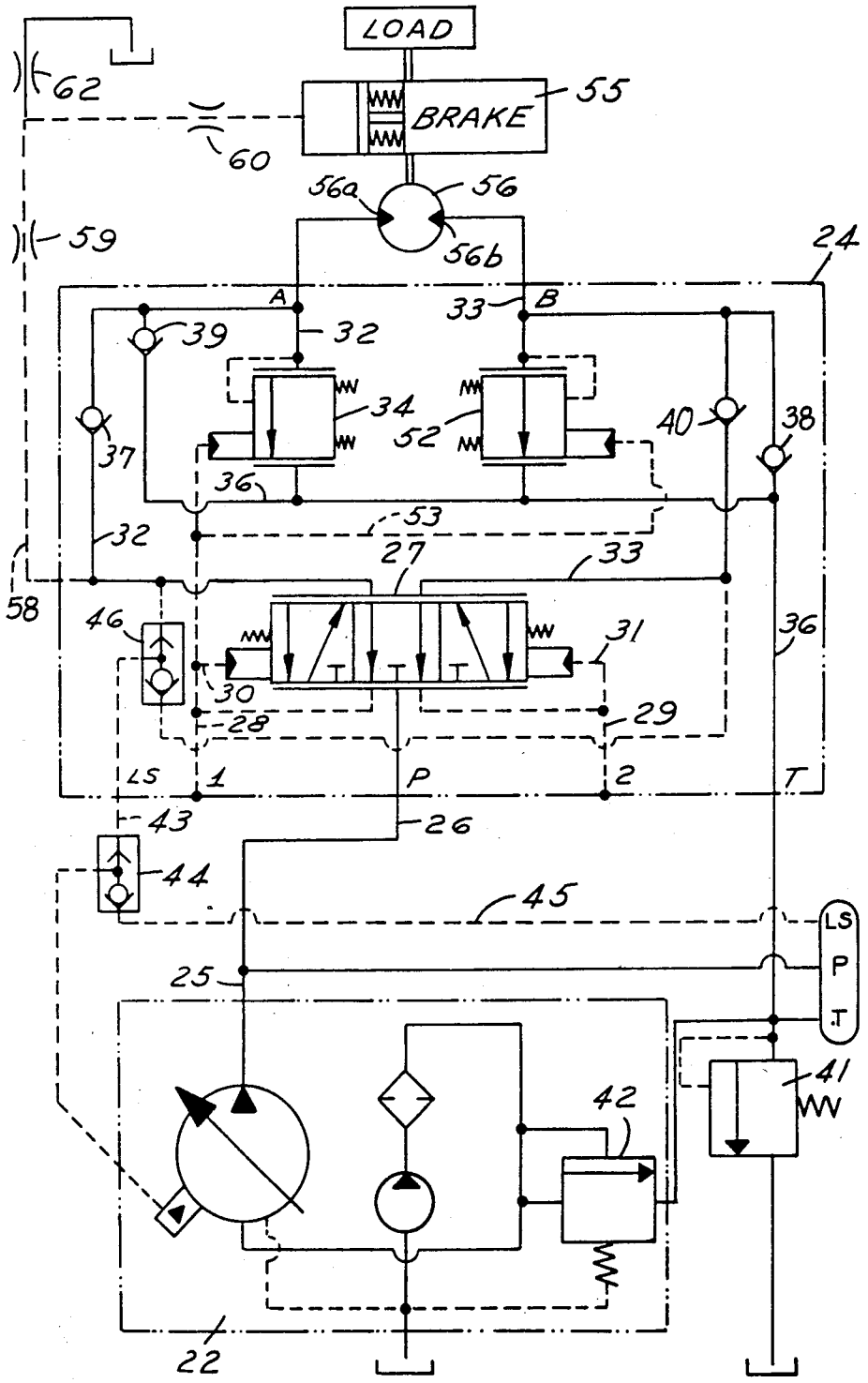
FIG. 6 is a schematic drawing of another hydraulic circuit embodying the invention.

The hydraulic circuit shown in FIG. 6 is similar to that shown in FIG. 3 except that the load piston 47 and associated line 48 are eliminated. When the meter-in valve 27 is operated to direct fluid to lower a load, the pressure of the fluid in line 32 is applied to disengage the brake 55. If the load tends to overrun, the pressure in line 32 is reduced tending to re-engage the brake.

When the meter-in valve 27 is moved to a neutral postion from a moved position, anti-cavitation valves 39, 40 serve to supply additional fluid to the inlet of the actuator to prevent cavitation of the actuator. In this situation, pressure in line 32 decays through line 28. The decay in pressure is sensed at the second meter-out valve 52 through line 58 causing the second meter-out valve 52 to close. Inertia of the load tends to force fluid out of the exhaust port of the actuator building up pressure in line 33. When the pressure in line 33 exceeds the relief setting of the second meter-out valve 52, the meter-out valve 52 opens again allowing the exhaust fluid to join the fluid being pumped through line 36 to the anti-cavitation valve 39 or 40 by the charge pump.

When meter-in valve 27 is operated to direct fluid to the actuator, restrictors 59 and 62 placed in lines 58 and 61 to the brake 55 provide for an approximately four to one (4:1) build-up of pressure between the pressure, i.e., the second meter-out valve 52 will crack open at one-fourth the pressure line 32. The build-up of the pressure in line 32 will apply back pressure on anti-cavitation valve 39 preventing recirculation of fluid exhausting from the second meter-out valve 57 to the actuator. Such recirculation of fluid would result in undesirable overspeeding when the actuator is driven by an overhauling load. Applying back pressure to the anti-cavitation valve 39 also prevents overheating of the actuator by the pump. Restrictors 59 and 62 in combination with restrictor 60 in line 58 also augment the load stability by providing additional damping to the system, i.e., slowing the speed of response of the second meter-out valve 52 when subjected to sudden pressure surges.

Figure 7:
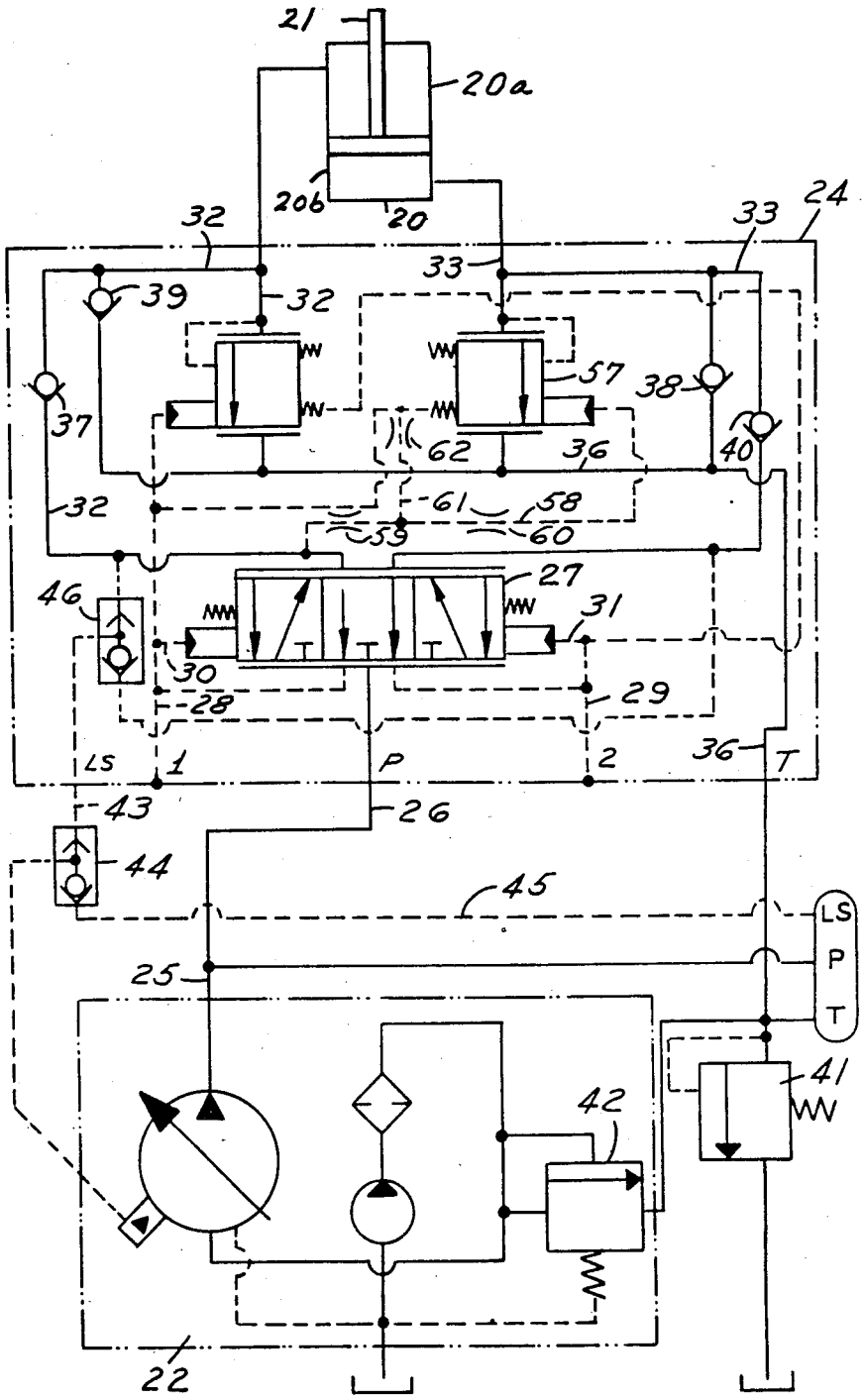
FIG. 7 is a schematic drawing of another hydraulic circuit embodying the invention.
Figure 9:
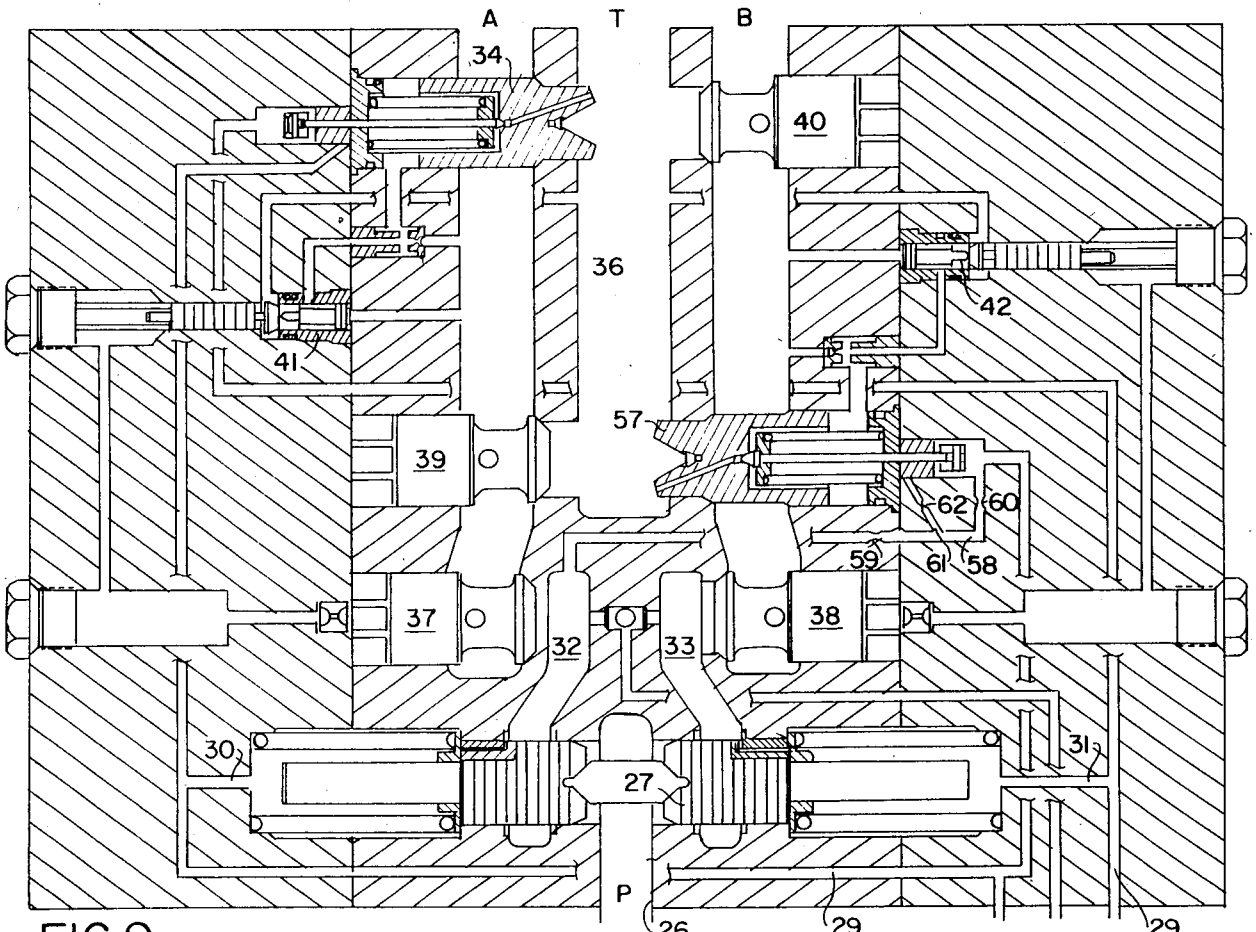
FIG. 9 is a sectional view of a valve system embodying the hydraulic circuit of FIG. 7.

The hydraulic circuit shown in FIG. 7 utilizes the restrictors 59, 60 and 62 in the manner of the circuit shown in FIG. 4. When meter-in valve 27 is operated to direct fluid to the actuator, restrictors 59 and 62 placed in lines 58 and 61 provide for an approximately four to one (4:1) build-up of pressure between the pressure in lines 32 and 58 i.e. the second meter-out valve 57 will crack open at one-fourth the pressure in line 32. The build-up of the pressure in line 32 will apply back pressure on anti-cavitation valve 39 preventing recirculation of fluid exhausting from the second meter-out valve 57 to the actuator. Such recirculation of fluid would result in undesirable overspeeding when the actuator is driven by an overhauling load. Applying back pressure to the anti-cavitation valve 39 also prevents overheating of the actuator by allowing fresh fluid to be applied to the actuator by the pump. Restrictors 59 and 62 in combination with restrictor 60 in line 58 also augment the load stability by providing additional damping to the system, i.e. slowing the speed of response of the second meter-out valve 57 when subjected to sudden pressure surges. FIG. 9 shows the manner in which the restrictors 59, 60, 62 of FIG. 7 are made an internal part of the valve body embodying the hydraulic circuit.

Figure 8:
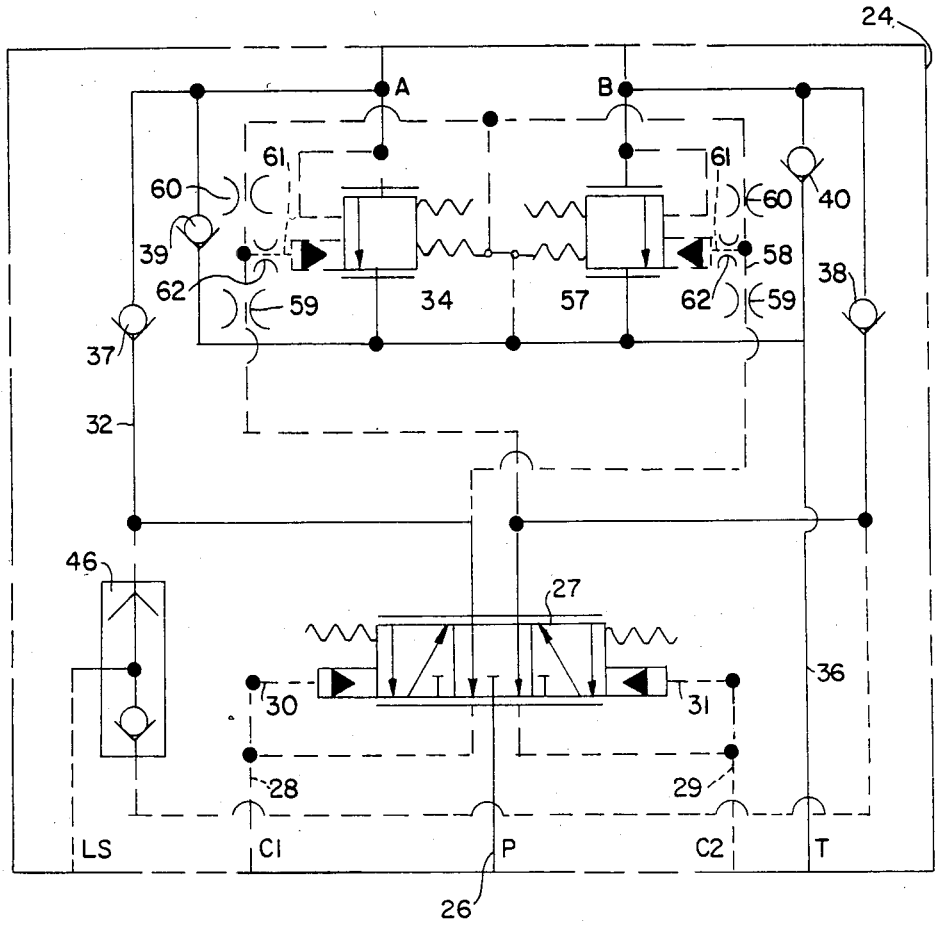
FIG. 8 is a schematic drawing of another hydraulic circuit embodying the invention.
Figure 10:
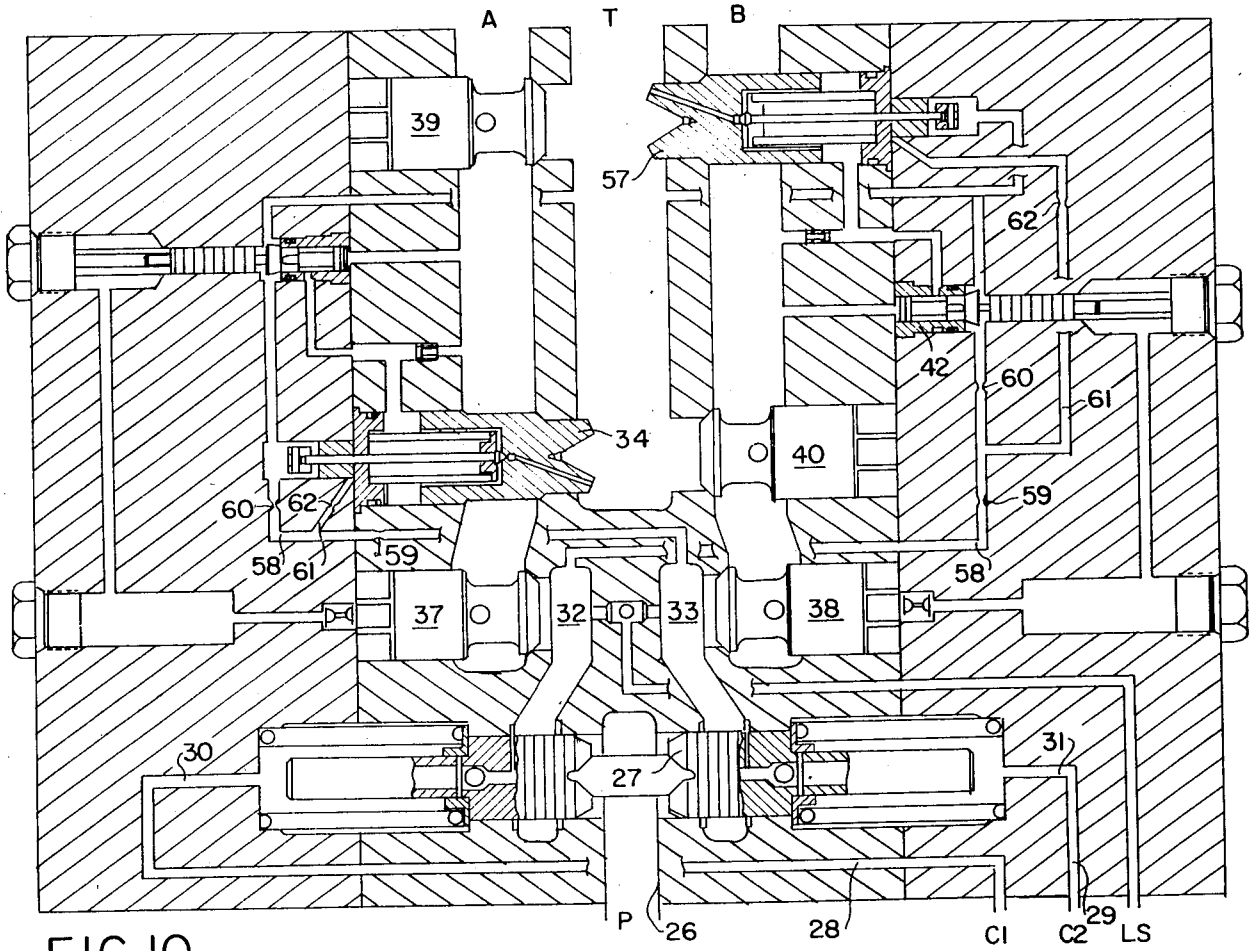
FIG. 10 is a sectional view of a valve system embodying the hydraulic circuit shown in FIG. 8.

FIG. 8 is a schematic of a hydraulic circuit wherein both meter-out valves are normally closed and have associated therewith restrictors 59, 60 and 62 with the meter-out valve 34 in a manner similar to FIGS. 4 and 5. FIG. 10 shows the manner in which the restrictors 59, 60, 62 of FIG. 7 are made an internal part of the valve body embodying the hydraulic circuit of FIG. 8.

What is claimed is:

1. A hydraulic control system comprising a hydraulic actuator having opposed openings adapted to alternately function as inlets and outlets for moving the element of the actuator in opposite directions, a pump for supplying fluid for said actuator, meter-in valve means to which the fluid from the pump is supplied for selectively metering fluid to one or the other of said openings to control the direction of movement of the acutator, said meter-in valve means being pilot controlled by alternately applying fluid at pilot pressure to said meter-in valve means, a pair of hydraulic lines extending from said meter-in valve means to said respective openings of said actuator, normally closed meter-out valve means associated with each opening of the actuator for controlling the flow out of said actuator, anti-cavitation valve means associated with each hydraulic line, passage means extending between one of said hydraulic lines associated with one of the openings of said actuator and the meter-out valve means associated with the other hydraulic line that extends to the other opening of the actuator, and restrictor means associated with said passage means operable, when the meter-in valve means is operated to supply pressure to said one hydraulic line, to reduce the pressure tending to open the meter-out valve means associated with the other hydraulic line and to cause the pressure in said one hydraulic line to increase the pressure opposing the opening of the anti-cavitation valve in said one hydraulic line wherein said passage means and restrictor means comprises a first hydraulic restrictor line extending from said one hydraulic line to tank and having a pair of restrictors therein to provide reduced pressure and a second hydraulic line having a restrictor therein and extending from a point between said restrictors in said first hydraulic line to said meter-out valve means.

2. The hydraulic control system set forth in claim 1 including means for sensing the outlet pressure being directed to the actuator when the meter-in valve means is operated and providing a pressure proportional to outlet pressure on said meter-in valve means opposing the force of pilot pressure tending to actuate the meter-in valve means.

* * * * *